United States Patent [19]

Abbott et al.

[11] 4,095,318

[45] Jun. 20, 1978

[54] CONTROLLED TOW STRETCHER

[75] Inventors: James Gardner Abbott; Jerry Wayne Berley; Allen Edens Ward, Jr.; Brandi, Sr. Adolph John, all of Columbia, S.C.

[73] Assignee: Allied Chemical Corporation, Morris Township, N.J.

[21] Appl. No.: 596,042

[22] Filed: Jul. 15, 1975

[51] Int. Cl.[2] ..... D02J 1/22

[52] U.S. Cl. ..... 28/241; 226/42; 226/111

[58] Field of Search ..... 28/71.3, 1.6, 1.7, 241; 226/42, 111

[56] References Cited

U.S. PATENT DOCUMENTS

| | | | |
|---|---|---|---|
| 2,123,936 | 7/1938 | Dreyfus et al. | 28/71.3 |
| 2,359,170 | 9/1944 | Symmes | 28/71.3 |
| 2,627,103 | 2/1953 | Jennings | 28/71.3 UX |
| 2,999,295 | 9/1961 | Manning et al. | 226/42 X |
| 3,266,082 | 8/1966 | Bandi | 28/71.3 |
| 3,296,680 | 1/1967 | Iwnicki et al. | 28/1.7 |
| 3,983,608 | 10/1976 | Stanley | 28/1.6 X |

*Primary Examiner*—Robert R. Mackey
*Attorney, Agent, or Firm*—Richard A. Anderson

[57] ABSTRACT

This is an improved apparatus for stretching a tow of filaments by the tension caused by driven rolls dragging the tow across drag rolls. The improvement comprises continuously controlling at least one undriven or drag roll proportional to the sensed variation in a ratio of speed between at least one driven roll and at least one drag roll.

2 Claims, 3 Drawing Figures

CONTROLLED TOW STRETCHER

BACKGROUND OF THE INVENTION

This invention relates to an improved apparatus and process for stretching a tow of filaments by tension on the tow caused by driven rolls dragging the tow across drag rolls. The improvement comprises continuously controlling at least one undriven roll proportional to a sensed variation in a ratio of speed between at least one driven roll and at least one drag or undriven roll. The tow stretching apparatus of the prior art is described in U.S. Pat. No. 3,266,082 to Brandi, hereby incorporated by reference in toto. See also U.S. Pat. No. 3,422,492 to Gorecki, pertinent portions of which are hereby incorporated by reference.

Fiber processed by the prior art process and apparatus lacks uniformity in denier, elongation, tenacity, and crimps per inch. These parameters must be uniform, particularly with certain spinning machinery used to spin the staple fiber to yarn. Also non-uniformity in these products creates streaks in dyed fabrics such as carpet.

The prior art apparatus for stretching a tow of filaments comprises travelling the tow serially through drag rolls and driven rolls with the tow being stretched by the tension on the tow caused by the driven rolls dragging the tow across the drag rolls with at least one of the drag rolls being braked or locked. Also a nip roll stand can precede the drag rolls with driven crimper feed rolls, driven crimper nip rolls, and a crimper box in series subsequent to the driven rolls. The prior art has means to drive the driven rolls, crimper feed rolls and crimper nip rolls, means to selectively lock (to prevent rotation) or brake at least one of the drag rolls and means to mount the rolls and crimper box. A single means such as an electric motor can be used to drive all the driven rolls, crimper feed rolls and crimper nip rolls. The prior art process is for stretching a tow of filaments by tension on the tow caused by driven rolls dragging the tow across a braked or locked drag roll. Fluctuations in the pretension at the nip roll stand have caused significant non-uniformity in drawn fiber denier, elongation, and tenacity.

SUMMARY OF THE INVENTION

The improvement of the apparatus of this invention comprises a speed control device such as an eddy current or a variable speed motor which continuously controls at least one of the undriven rolls, such as one or more rolls at the nip roll stand or the drag rolls, proportional to the sensed variation in a predetermined or set ratio of speed of at least one driven roll compared to at least one undriven roll such as the drag or nip roll stand roll. Although with the speed control device of this invention, no drag roll need be braked, preferably one drag roll is locked. The preferred speed control device is an eddy current brake. The speed control device such as the eddy current brake can be applied to the drag rolls but is preferably applied to two of the rolls on the nip roll stand. The speed can be sensed with any conventional rpm detecting device such as a "tach" generator or gear tooth magnetic pick-up. Preferably, the speed on the driven roll is sensed on the last set of three sets of driven rolls and compared to a set ratio of the speed of the driven rolls to the controlled undriven rolls such as the two nip rolls on the nip roll stand or any two drag rolls.

The improvement in the process of this invention comprises sensing the variation in a set ratio or speed between at least one driven roll and at least one drag roll and continuously controlling at least one undriven roll proportional to the sensed variation in ratio of speed between at least one driven roll and at least one undriven roll. Preferably, the undriven roll is in the nip roll stand, but it can be any drag roll. Preferably, at least one of the drag rolls is locked but it could also be braked by means such as the standard brake shoe device.

This invention is used to stretch tow as described in the prior art. This tow can be cut into staple and spun into yarn to prepare carpets.

Further detail is available in the above cited Brandi and Gorecki patents incorporated by reference herein.

DESCRIPTION OF THE PREFERRED EMBODIMENTS

Figure 1:
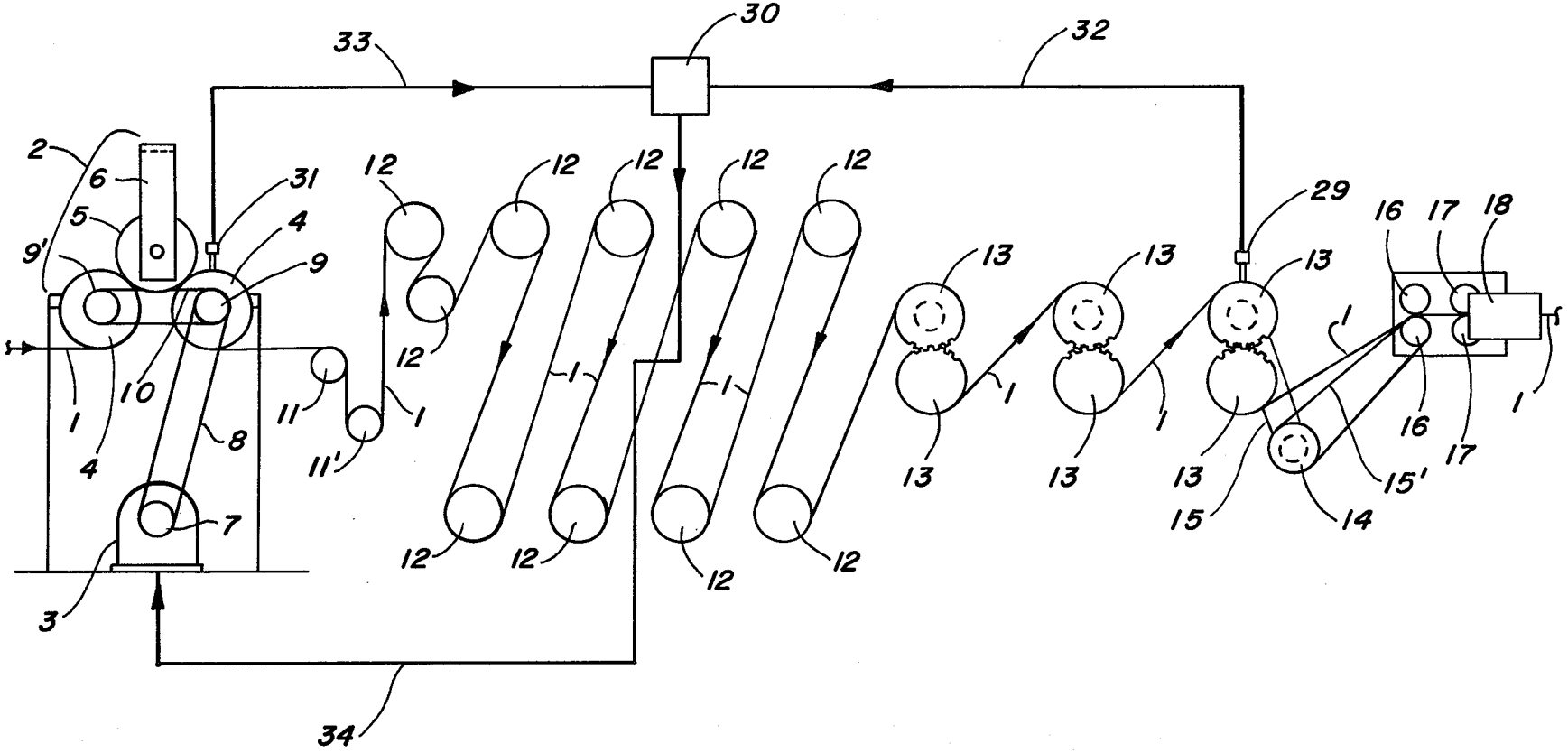
FIG. 1 is a schematic side view of the apparatus of this invention.

In FIG. 1, the yarn tow 1 passes first through nip roll stand 2 having nip rolls 4 and slidably mounted nip roll 5 mounted in bracket 6. The degree of pressure on the yarn tow by the nip roll stand is adjusted by adjusting the position of nip roll 5 in bracket 6 upwardly or downwardly. Speed control device such as eddy current brake 3 controls the speed of the nip rolls 4 by means of the pulley 7 on eddy current brake 3 and pulleys 9 and 9' on nip rolls 4 connected by belts 8 and 10 as shown. Yarn two 1 then passes across guide cylinder 11 and drag roll 11' to a series of drag rolls 12, then to a series of driven rolls 13 which are driven by means of electric motor 21 shown in FIG. 2. Drive shaft 14 is also connected to electric motor 21 shown in FIG. 2 by means of belts 15 and in turn drives crimper feed rolls 16 and crimper nip rolls 17 by means of belt 15'. Yarn tow 1 then passes into crimper box 18 and exits as shown, stretched and crimped ready for further processing.

Figure 2:
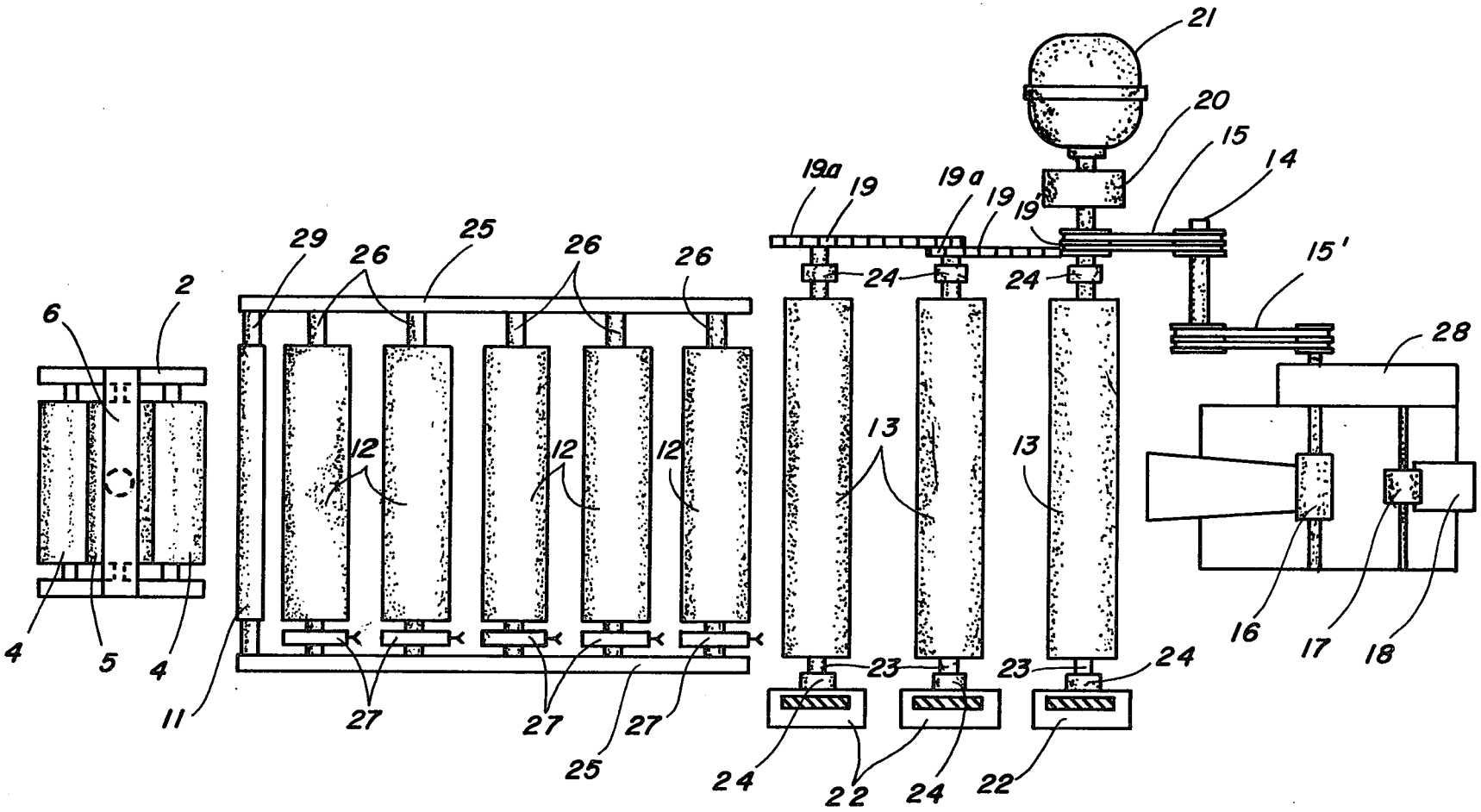
FIG. 2 is a schematic top view of the apparatus of this invention.

In FIG. 2, like numbers indicate identical elements. Nip roll stand 2 has nip rolls 4 and adjustable nip roll 5 mounted in bracket 6. Yarn tow passes from nip roll stand 2 across guide roll 11 and drag rolls 11' and 12 to driven rolls 13, driven by electric motor 21 through gear box 20. The combination pulleys 19' drive the chains 19 connected to sprockets **19*a*, and also drive belts 15 which drive jack shaft 14 by means of belts 15' to drive gears under cover 28. Feed rolls 16 and crimper nip rolls 17 are driven by the gear system under cover 28 and not shown except in the references incorporated by reference into this patent application. Feed rolls 16 and crimper nip rolls 17 feed yarn tow to crimper box 18. Driven rolls 13 are mounted on shafts 23 in bearings 24 on a stand 22. Guide roll 11 and drag rolls 11', 12 are mounted in frame 25. Guide roll 11 is mounted on shaft 29 and drag rolls 11', 12 are mounted on shafts 26. Each drag roll 12 has a lockable brake 27** described in detail in the incorporated Brandi patent.

The improvement of this invention can be seen in FIG. 1. It begins with the revolutions per minute speed sensors 29 and 31 sensing the speed of the last set of driven rolls 13 and one of the nip rolls 4 as shown. This speed is communicated through electric line connections 32 and 33 to controller 30 which senses the variation in a set ratio of speed between the driven roll and the nip roll. This controller then communicates through line 34 to eddy current brake 3 to continuously proportionally control the speed of nip rolls 4 by variation in the voltage to eddy current brake 3 which acts as a brake on rolls 4 through pulleys, 7, 9 and 9' and belts 8 and 10.

Figure 3:
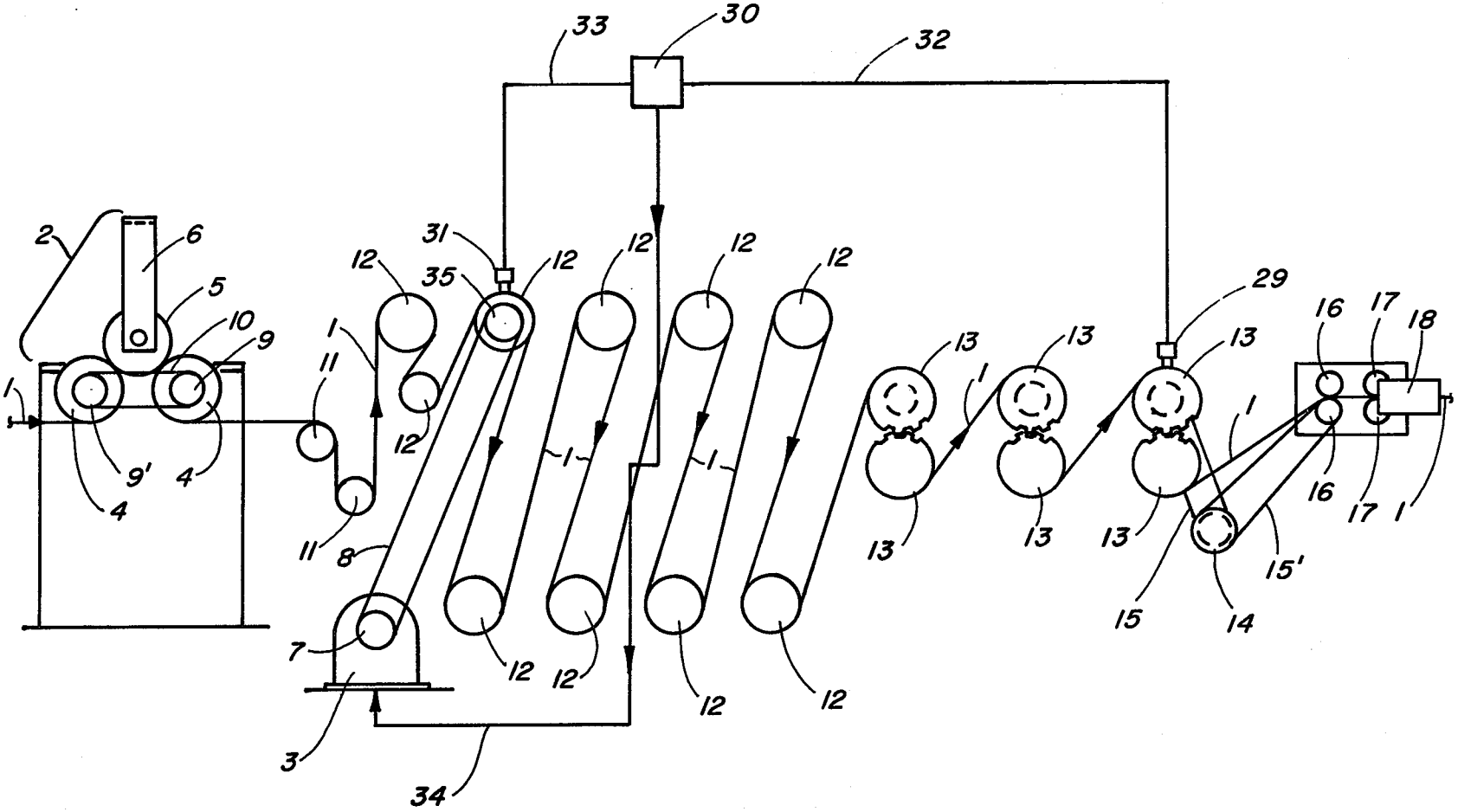
FIG. 3 is a schematic side view of the apparatus of this invention showing another embodiment of the invention.

In FIG. 3, like numbers indicate identical elements as those in FIGS. 1 and 2. FIG. 3 shows speed control applied to the drag rolls 12 rather than the nip rolls 4. Speed sensor 31 is located on drag roll 12 rather than on nip roll 4. The speed of the rolls from speed sensors 29 and 31 sensing the speed of the last set of driven rolls 13 and one of the drag rolls 12 is shown. This speed is communicated through electric line connections 32 and 33 to control at 30 which senses the variation in a set ratio of speed between the driven roll and the nip roll. This controller then communicates through line 34 to eddy current brake 3 to continuously proportionally control the speed of drag roll 12 by variation in the voltage to the eddy current brake 3 which acts as a brake on roll 12 through pulleys 7 and 35 and belt 8.

Using the apparatus and process of this invention to prepare 448,000 pounds of a predominantly amine terminated Y-cross section nylon yarn, the following table shows the uniformity achieved by this invention compared to use of the prior art uncontrolled apparatus to prepare 437,000 pounds under similar operating conditions. "C. O. V." means "coefficient of variation", which is defined as the standard deviation between samples times 100 divided by the arithmetic mean.

TABLE

| | | This Invention | Prior Art |
|---|---|---|---|
| DENIER | Avg. | 17.3 | 17.4 |
| | C.O.V. | 2.8% | 3.3% |
| | Number samples | 46 | 49 |
| ELONGATION* | Avg. | 74.5 | 77 |
| | C.O.V. | 7.1% | 9.3% |
| | Number samples | 48 | 51 |
| TENACITY* | Avg. | 4.0 gpd | 4.0 gpd |
| | C.O.V. | 5.9% | 7.3% |
| | Number samples | 48 | 51 |
| CRIMPS/Inch | Avg. | 10.0 cpi | 9.9 cpi |
| | C.O.V. | 7.3% | 10.8% |

TABLE-continued

| | | This Invention | Prior Art |
|---|---|---|---|
| | Number samples | 107 | 115 |

*ASTM D 2256-69

Crimps per inch for the above table were determined visually with a magnifier. The table shows significant improvement in the uniformity of denier, elongation, breaking strength (i.e., tenacity) and crimps per inch.

We claim:

1. An apparatus for stretching a tow of filaments comprising said tow traveling serially through, in combination, a nip roll stand, said stand having rolls, drag rolls, and driven rolls, with means to drive said driven rolls, means to mount said rolls, means to sense variation in a set ratio of speed between said nip rolls and said driven rolls, and a speed control device, communicating with said means to sense, said device continuously controlling at least one roll in said nip roll stand proportional to said sensed variation in the ratio of speed, said tow being stretched by the tension on said tow caused by the driven rolls dragging said tow across said drag rolls.

2. An apparatus for stretching a tow of filaments comprising said tow traveling serially through, in combination, a nip roll stand, said stand having rolls, drag rolls, and at least three sets of driven rolls, with electric motor means to drive said driven rolls, means to mount said rolls, means to selectively lock said drag rolls to prevent rotation and at least one of said drag rolls being locked to prevent rotation, means to sense variation in a set ratio of speed between said nip rolls and driven rolls, an eddy current brake, communicating with said means to sense, said brake continuously controlling at least one roll in said nip roll stand, proportional to said sensed variation in the ratio of speed, and said means to sense variation in said set ratio of speed being sensed on a roll on said nip roll stand and on the last of said three sets of driven rolls, and said eddy current brake being applied to two rolls on said nip roll stand, said tow being stretched by the tension on said tow caused by the driven rolls dragging said tow across said drag rolls.

* * * * *